US006810707B2

(12) United States Patent
Friedman et al.

(10) Patent No.: US 6,810,707 B2
(45) Date of Patent: Nov. 2, 2004

(54) COMPRESSED-RADIUS HEM-FORMING PROCESS AND TOOL

(75) Inventors: Peter A. Friedman, Ann Arbor, MI (US); William Faitel, Chesterfield Township, MI (US); Jaideep Samant, Chesterfield Township, MI (US); Patrick Coughlin, Chesterfield Township, MI (US); Phil Wiens, Chesterfield Township (CA); Doug Schrandt, Chesterfield Township, MI (US); Craig Eugene Miller, Clinton Township, MI (US); Zhiyong Cedric Xia, Canton, MI (US)

(73) Assignees: Ford Motor Company, Dearborn, MI (US); Unova Industrial Automation Systems, Inc., Warren, MI (US)

( * ) Notice: Subject to any disclaimer, the term of this patent is extended or adjusted under 35 U.S.C. 154(b) by 0 days.

(21) Appl. No.: 10/063,757

(22) Filed: May 10, 2002

(65) Prior Publication Data

US 2003/0209048 A1 Nov. 13, 2003

(51) Int. Cl.[7] ..... B21D 39/02
(52) U.S. Cl. ..... 72/220; 29/243.58
(58) Field of Search ..... 72/220; 29/243.5, 29/243.57, 243.58, 509

(56) References Cited

U.S. PATENT DOCUMENTS

| | | | | | |
|---|---|---|---|---|---|
| 1,289,602 | A | * | 12/1918 | Baehr | 492/1 |
| 4,103,406 | A | * | 8/1978 | Ito et al. | 492/1 |
| 5,224,253 | A | * | 7/1993 | Sawa | 29/243.58 |
| 5,267,387 | A | | 12/1993 | Sawa | |
| 5,457,981 | A | | 10/1995 | Brown et al. | |
| 5,740,691 | A | | 4/1998 | Kovarovic et al. | |
| 6,000,118 | A | * | 12/1999 | Biernat et al. | 29/458 |
| 6,257,043 | B1 | * | 7/2001 | Wiens | 72/412 |
| 6,477,879 | B1 | * | 11/2002 | Sawa | 72/220 |
| 2001/0029766 | A1 | | 10/2001 | Wiens | |

FOREIGN PATENT DOCUMENTS

| | | | | | |
|---|---|---|---|---|---|
| EP | 0 988 906 | A3 | | 8/1999 | |
| EP | 0 988 906 | A2 | | 8/1999 | |
| JP | 61-262432 | | | 5/1985 | |
| JP | 4-253524 | | | 1/1991 | |
| JP | 6-344037 | | | 6/1993 | |
| JP | 7-60370 | | | 8/1993 | |
| JP | 07290158 | A | * | 11/1995 | B21D/19/12 |
| JP | 2002102957 | A | * | 4/2002 | B21D/39/02 |
| JP | 2002-341842 | | * | 5/2002 | B21D/39/02 |

* cited by examiner

*Primary Examiner*—Lowell A. Larson
(74) *Attorney, Agent, or Firm*—Raymond L. Coppiellie; Brooks & Kushman, PC

(57) ABSTRACT

A tool and process utilizing the tool for forming a compressed-radius hem on a sheet metal assembly is provided. A concave portion on the tool is formed by at least two surfaces that together define a cavity. A flange on the perimeter of an outer panel is initially formed to an approximate perpendicular angle and is then formed to about 45°. In a final forming step, an intermediate portion of the flange is engaged by the cavity and is formed into a compressed-radius hem.

16 Claims, 3 Drawing Sheets

COMPRESSED-RADIUS HEM-FORMING PROCESS AND TOOL

BACKGROUND OF INVENTION

1. Field of the Invention

The present invention relates to a process and tool for forming a compressed-radius hem on an outer panel to join it to an inner panel to form a sheet metal assembly.

2. Background Art

Hemming is a production process for joining an outer panel to an inner reinforcement panel. Conventional hemming processes are accomplished by bending a flange of the outer panel back onto the inner panel. Normally, a three-step process is used. In the first step, the outer panel is flanged with a perimeter portion being formed to extend substantially perpendicularly relative to the body of the outer panel. In the second step, the panel is pre-hemmed wherein the flange is formed to an acute angle of approximately 45° to extend inwardly over a perimeter portion of the inner panel. In the third step, the panel is finally hemmed wherein the flange is formed to engage the inner panel and extend parallel to the body of the outer panel and perimeter portion of the inner panel.

Several different types of tools are used to perform hemming processes including reciprocating ram presses, tabletop hemming tools, and roll forming tools that may be manipulated by a robot. In conventional roll formed hem operations, a first pass is required to bend a 90° flange to an intermediate angle of about 45°. The hem is closed in a second pass.

Recent developments in the field of hem forming have led to the development of reduced radius hems that improve the appearance of the fit of adjacent panels by reducing the perceived margin between adjacent panels. In conventional hem forming processes, the hem radius is controlled by the thickness of the inner and outer panels.

One problem with reduced radius hems is a tendency of the resulting hem to fracture near the tip of the hem if the part and tools are not properly aligned. One example of this hemming method and tooling is disclosed in U.S. Pat. No. 6,257,043 to Wiens and in Publication No. US 2001/0029766A1 that both relate to producing reduced radius hems. The final hem tool includes a flat section and an inclined section that can produce a hem with a reduced radius when compared to a conventional flat hem. In automotive manufacturing, for example, there are tolerances allowed both as to the relative location of the inner panel, outer panel, and the hem tool. These tolerances may result in variances with respect to the hem tool and flange location that are not a problem with conventional flat hemming techniques because the flat hem tool is not sensitive to inboard/outboard alignment of the tool relative to the flange. In the Wiens patent, if the final hem steel is too far inboard, the hem tip may be distorted and will either fail or result in an unattractive hem.

The use of a curved forming tool for forming a hem is disclosed in U.S. Pat. No. 6,000,118 to Biernat et al. that relates to a reciprocating ram press tool forming a sealed edge joint. The Biernat patent does not disclose a tool or method for producing a compressed-radius hem.

The disadvantages and shortcomings of the prior art are addressed by Applicant's invention as summarized below.

SUMMARY OF INVENTION

According to one aspect of the present invention, a tool is provided for forming a compressed-radius hem on a sheet metal assembly comprising an inner panel having an outwardly extending flange and an outer panel having a bendable flange. The bendable flange is initially located generally perpendicular to an outer peripheral portion of the outer panel. The tool cooperates with a supporting surface on which the outer panel and inner panel are located. According to one embodiment of the invention, a roller having a cylindrical surface is used to bend the flange inwardly toward the surface of the outwardly extending flange of the inner panel. The roller also has a concave portion extending from a first circumferential line at the intersection of the concave portion and the cylindrical surface to a second circumferential line axially spaced from the first circumferential line. The concave portion is formed by at least two surfaces that together define a cavity relative to a chord extending between the first and second circumferential lines.

According to other aspects of the invention, the surfaces defining the cavity may include two or more partially conical surfaces that lie in two different coaxial conical sections that are coaxial with the cylindrical surface. Three, four, or more conical surfaces may be provided. The surfaces defining a cavity may also include a conical surface and a curved surface that is contiguous with the conical surface and also coaxial with the cylindrical surface. The curved surface may be located between the conical surface and the cylindrical surface and may be contiguous with both surfaces.

According to additional aspects of the invention, the cylindrical surface may be oriented to contact an inner portion of the flange as it is pressed against the outwardly extending flange of the inner panel while at least one of the surfaces forming the concave portion engages an intermediate portion of the flange that extends from a bight portion of the flange to the inner portion. A bend in the flange between the inner portion of the flange and the intermediate portion of the flange is preferably engaged by the roller near the first circumferential line. The concave portion preferably applies force in a direction normal to the intermediate portion of the flange. The cylindrical surface preferably applies force to the inner portion of the flange to flatten the flange against the outwardly extending flange of the inner panel.

According to yet another aspect of the invention, the same cylindrical surface used in the final hemming step may be used in the pre-hemming step to initially bend the flange from its initial generally perpendicular orientation to extend at an angle of about 45° and partially over the outwardly extending flange of the inner panel. A concave portion in one embodiment may have an outer circumference that is greater than the cylindrical surface. In yet another embodiment, the concave portion may have an outer circumference that is less than the circumference of the cylindrical surface.

According to another aspect of the invention, a tool for forming a hem on a sheet metal assembly comprising an inner panel having an outwardly extending flange and an outer panel having a bendable flange comprises a support on which the outer panel and inner panel are located and a hem tool having a first surface that is parallel to the supporting surface, a second surface obliquely angled relative to the first surface and extending towards the supporting surface, and a third surface obliquely angled relative to the second surface and extending towards the supporting surface wherein the third surface is less oblique relative to the first surface than the second surface.

According to another aspect of the invention, the first surface is oriented to contact an inner portion of the flange as it is pressed against the outwardly extending flange of the inner panel while the second surface engages an intermediate portion of the flange that extends from a radiused portion to the inner portion. A bend in the flange between the inner portion of the flange and the intermediate portion of the flange may be engaged by the intersection of the first section and second section. The forming tool may be either a roller or a reciprocating ram press die.

According to another aspect of the invention, a method of hemming an outer metal panel having a perimeter flange and an inner metal panel together comprises the steps of placing the inner panel and outer panel together on a supporting surface. Forming a perimeter flange of the outer panel to extend generally perpendicularly relative to the body of the outer panel. In a pre-hemming pass, the perimeter flange is formed to an acute angle relative to the body of the outer panel with a roller. The perimeter flange of the outer panel is then formed in a final pass into engagement and over a perimeter portion of the inner panel. The roller has a first forming surface that is parallel to the perimeter portion of the inner panel and a second forming surface that is contiguous with the first forming surface and is oriented at a first oblique angle relative to the first forming surface. In the final hemming pass the roller may be oriented with its axis of rotation generally parallel to an intermediate portion of the perimeter flange. In this way, the bending force is focused on the intermediate portion of the flange so that the overlapping portions of the inner and outer panels are allowed to slide more easily in a parallel direction as the hem is formed in the final hemming pass.

The method may also include providing a third forming surface that is spaced from the first forming surface and contiguous with the second forming surface. The third forming surface may be oriented at a second oblique angle relative to the first forming surface that is less oblique than the first oblique angle.

DETAILED DESCRIPTION

Figure 1:
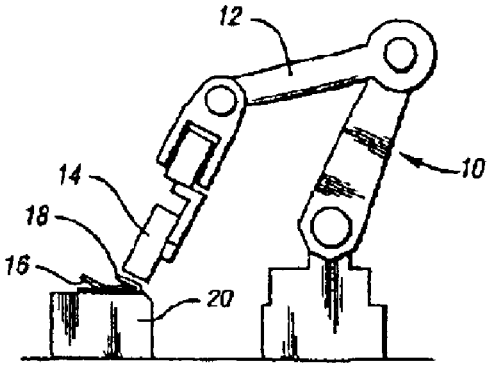
FIG. 1 is a schematic representation of a robotic roll hem machine.

Referring now to FIG. 1, a robotic hemming machine 10 is shown to include an articulated arm 12 that manipulates a hem forming tool 14. An inner panel 16 and an outer panel 18 are shown disposed on a supporting surface 20. The outer panel 18 is shown in the condition that it would be after a first pre-hemming operation.

Figure 2:
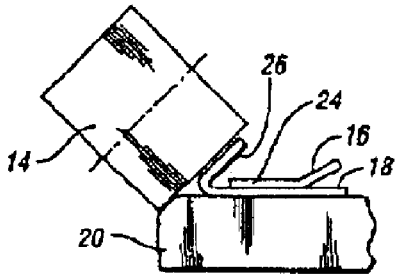
FIG. 2 is a schematic view showing a first pre-hem pass of a conventional roll hemming tool.

Referring now to FIG. 2, a cylindrical bending tool 14 is shown making a pre-hemming pass to bend a bending flange 24 of the outer panel 18 over an outwardly extending flange 24 of the inner panel 16. The precise degree of bending is not critical and could range from 30° to 60°. Forty-five degrees is nominally stated since it is halfway between the initial perpendicular orientation of the flange 26 that again may vary upon tooling requirements and 0° which is the orientation of the end of the bending flange 26 after the final hemming pass. Prior art roll form hemming tools generally include a cylindrical surface as shown by hem forming tool 14. Hem forming tools made according to the present invention may include a cylindrical portion that functions in the pre-hemming step in a similar manner to hem forming tool 14.

Figure 3:
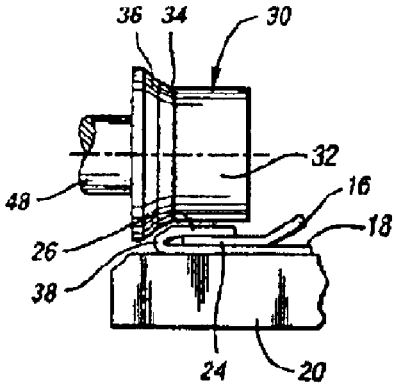
FIG. 3 is a schematic representation of a second, final hemming pass of a compressed-radius roll hemming tool made according to the present invention.

Referring now to FIG. 3, a hem forming tool made according to one embodiment of the present invention is generally referred to by reference numeral 30. The tool 30 has a cylindrical surface 32 that may be used in the pre-hemming step to form the flange 26 to approximately 45° and in the final hemming step to form the flange 26 onto the outwardly extending flange 24. A first oblique surface 34 is a flat surface extending radially outwardly at an oblique angle from the cylindrical surface 32. A second oblique surface 36 extends radially outwardly at an oblique angle from the first oblique surface 44. The first and second oblique surfaces 34 and 36 together form a concave portion that is used to form the compressed-radius hem 38.

Figure 4:
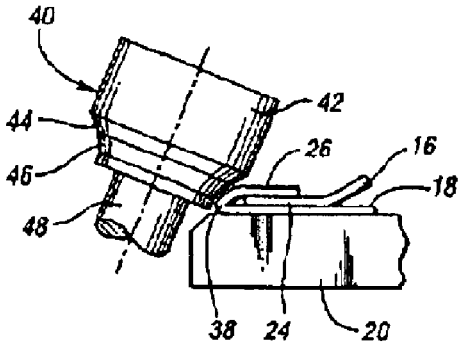
FIG. 4 is a schematic representation of a second, final hemming pass of an alternative embodiment of a compressed-radius roll hemming tool made according to the present invention.

Referring now to FIG. 4, another embodiment of the compressed-radius forming tool 40 is shown to include a cylindrical surface 42 that is used to form the pre-hemming operation and first and second oblique surfaces 44 and 46 that together form a concave portion that engages the bending flange 26 in the final hemming step. The tool 40 is mounted on and rotates around a rotatable shaft 48 that performs the hemming operations. Shaft 48 may be supported on its articulated arm 12.

Figure 5:
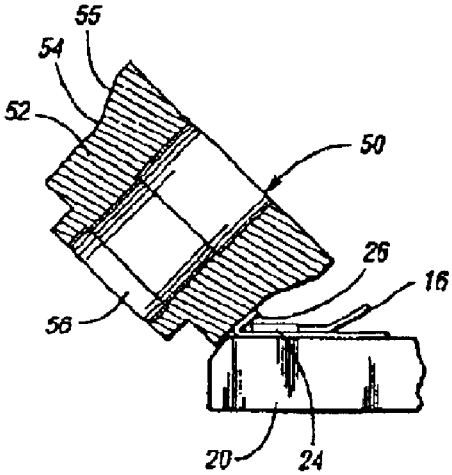
FIG. 5 is a schematic view of a pre-hem pass of a compressed-radius roll hemming tool having a partially curved surface.
Figure 6:
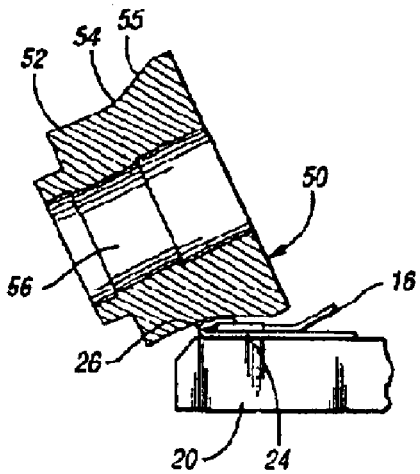
FIG. 6 is a schematic view showing a second, or final, pass of the compressed-radius roll hemming tool shown in FIG. 5.

Referring now to FIGS. 5 and 6, yet another embodiment of the hem forming tool 50 of the present invention is shown. The tool 50 includes a cylindrical surface 52 that is used in both the pre-hem and final hem passes. The pre-hem pass is shown in FIG. 5 while the final hemming pass is shown in FIG. 6. A partially curved surface 54 and a conical surface 55 are provided to bend the bending flange 26 of the outer panel 18 over the outwardly extending flange 24 of the inner panel 16 during the final hemming step as shown in FIG. 6. The partially curved surface 54 and conical surface 55 together define a concave portion that engages the bending flange 26.

Figure 7:
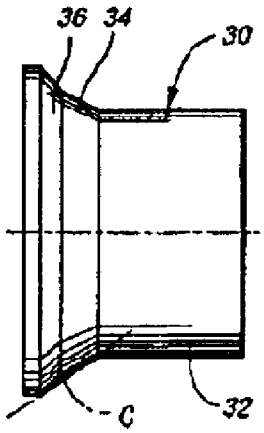
FIG. 7 is a schematic view showing a compressed-radius hem tool having a flat forming surface and two straight sections disposed at two different oblique angles.
Figure 8:
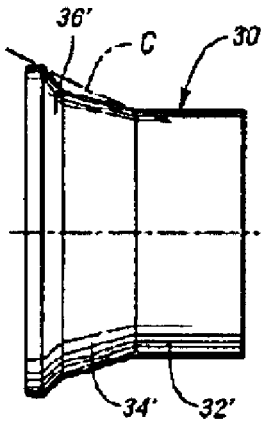
FIG. 8 is a schematic view showing a compressed-radius hem tool having a flat forming surface and two straight sections disposed at two different oblique angles.

Referring now to FIGS. 7 and 8, two different styles of the tool 30 are shown with FIG. 7 illustrating the surfaces of the tool 30 while FIG. 8 illustrates differently proportioned surfaces of the tool 30'. In each, a cylindrical surface 32, 32' is shown for use in the pre-hemming pass and the final hemming pass. A first oblique surface 34 is shown in FIG. 7 while in FIG. 8 surface 34' is substantially greater in length to provide additional tooling alignment flexibility. A second oblique surface 36 and 36' are shown in FIGS. 7 and 8, respectively. The first oblique surfaces 34, 34' and the second oblique surfaces 36, 36' together form a concave portion. A chord C relative to which the concave portion is concave is shown as a dashed line.

Figure 9:
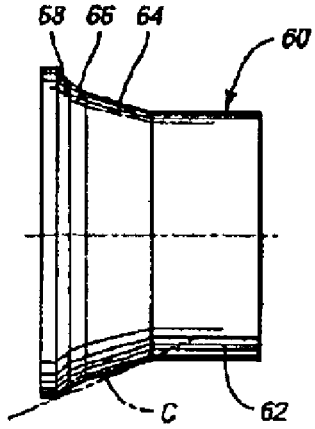
FIG. 9 is a schematic view showing a compressed-radius hem tool having a flat forming surface and three straight sections disposed at different oblique angles with the first section being substantially longer than the other two sections.

Referring now to FIG. 9, another alternative embodiment of the tool 60 is shown to include a cylindrical surface 64 and a first oblique surface 64, second oblique surface 66, and third oblique surface 68 of sequentially greater radial extent. It should be understood that additional oblique surfaces could be added within the spirit and scope of the invention. However, each separate surface on the forming tool may require additional machining steps and entail additional tooling costs. As the number of surfaces increases, the extent to which the surfaces may extend the length of the compressed-radius hem flange may be increased and the margin of error for alignment of the tool with the flange may be increased.

Figure 10:
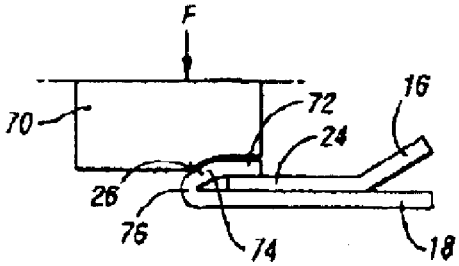
FIG. 10 is a schematic representation showing the forces applied in a final finish hem step using a compressed-radius tool having a partially curved surface.
Figure 11:
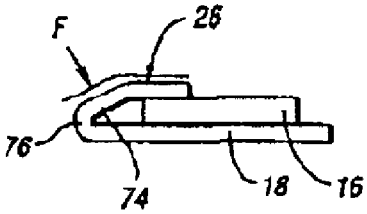
FIG. 11 is a schematic representation of a compressed-radius forming tool having a frustoconical surface and showing the force being applied in a direction normal to the intermediate portion of the flange.

FIGS. 10 and 11 feature force diagrams that illustrate two different directions that force may be applied to the bending flange 26. In FIG. 10, the pre-hemming forces are applied in the direction shown by force arrows F to the bending flange 26. The bending flange 26 is shown to include an inner portion 72 that is pressed against the outwardly extending flange 24 and an intermediate portion 74 that extends from the inner portion 72 to a radiused portion 76. In this embodiment and in the embodiment of FIG. 3, the principal force arrow F applies a downward force on the inner portion 72 of the flange 26.

Referring now to FIG. 11, force arrow F shows the preferred direction to apply force to the intermediate portion 74 of the flange 26 so that it reduces the tendency of the inner portion 72 of the flange 26 to resist shaping the intermediate portion 74 into the desired configuration. This advantage is also obtained in the embodiments shown in FIGS. 4–6 in which the roller axis is angled relative to the flange 24.

Figure 12:
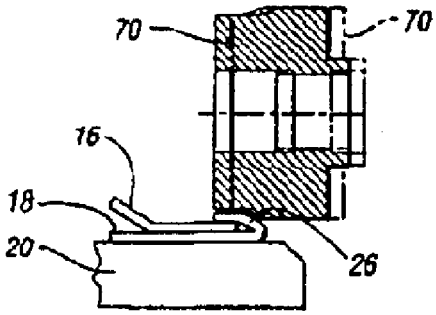
FIG. 12 is a schematic representation of a compressed-radius forming tool having a partially curved surface showing in phantom potential outboard movement of the roller.

Referring now to FIG. 12, the tool 70 is shown properly aligned with the flange 26 in solid lines and in phantom shown in a maximum outboard position in which an acceptable compressed-radius hem could be formed in the final hemming pass. However, between position shown in solid lines and position shown in phantom lines, a final hem could be formed with the tool 70.

Figure 13:
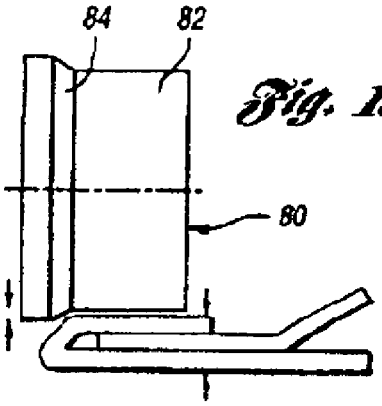
FIG. 13 is a schematic view showing the relative height of the inclined section being 25% of the total stack height.

Referring now to FIG. 13, another embodiment of the tool 80 is shown wherein a cylindrical surface 82 and oblique surface 84 are provided. In this embodiment, the stack height of the tool 80 represented by the difference in the minimum and maximum radius of the oblique surface 84 is approximately 25% of the stack height represented by the thickness of the hem illustrated by the arrows in the center portion of the drawing.

Figure 14:
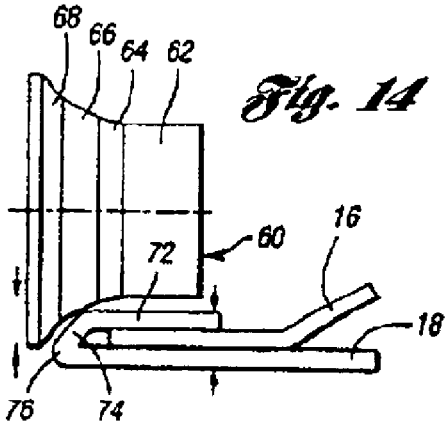
FIG. 14 is a schematic view showing the relative height of the inclined section being 100% of the stack height.

Referring now to FIG. 14, the concept of the present invention is shown wherein by providing additional oblique surfaces 64, 66, and 68, the stack height indicated by the arrows on the left side of FIG. 14 is equal to a stack height of the finished hem represented by the drawings in the center of FIG. 14. In accordance with the tool 60 shown in FIG. 14, considerable flexibility can be provided in forming a compressed-radius hem having a radiused portion, or bight, 76, intermediate portion 74, and inner portion 72.

Figure 15:
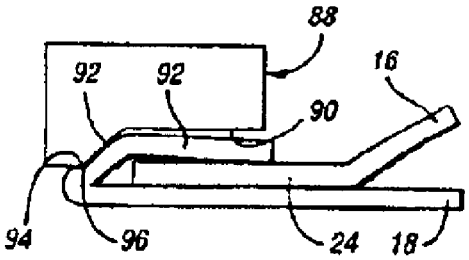
FIG. 15 is a schematic view showing a hem tool for a reciprocating ram press having a flat hemming surface and a single angled surface with the tool being misaligned too far inboard.

Referring now to FIG. 15, a reduced radius hem tool 88 for a reciprocating press is shown. The reduced radius hem tool 88 includes a flat forming surface 90 and an inclined forming surface 92 that are designed to engage and form a final hem after the flange 26 has been processed in a pre-hemming step as shown in FIG. 2 as described above. A corner 94 can cause a deformation 96 in the flange 26 if the tool and inner and outer panels 16 and 18 are not properly aligned prior to the final hemming press step. The deformation 96 can cause a panel to be rejected or result in body panels having a poor appearance.

Figure 16:
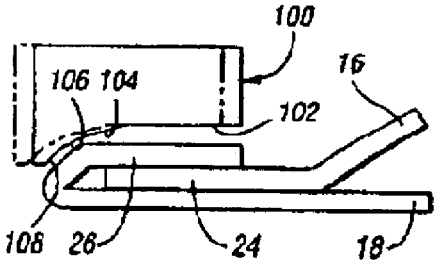
FIG. 16 is a schematic view showing the flexibility of the compressed-radius hem tool with respect to the relative position of the hem tool and the flange.

Referring now to FIG. 16, a compressed-radius hem tool 100 is shown in conjunction with a compressed-radius hem formed on an inner and outer panel assembly wherein the bending flange 26 is bent over the outwardly extending flange 24 of the inner panel 16. The compressed-radius hem tool 100 includes a flat forming surface 102 and first, second and third inclined forming surfaces 104, 106, and 108 that are each oriented at an oblique angle relative to the flat forming surface 102. The inclined forming surfaces 104, 106, and 108 are sequentially less oblique. Stated otherwise, the angular orientation of the first, second and third inclined forming surfaces increases to provide an increased radius on the forming tool 100 as the sections increase in distance from the flat forming surface 102. The series of inclined forming surfaces provide a concave portion and allow greater manufacturing tolerances wherein the tool 100 may be aligned with the bending flange 26 in a range of positions from that shown in solid lines in FIG. 16 to the dotted line position shown in FIG. 16. This greater degree of manufacturing tolerances results in increased workmanship and higher quality compressed-radius hems.

Figure 17:
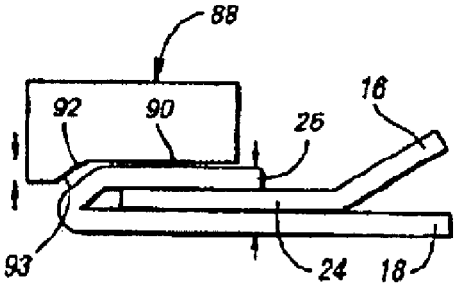
FIG. 17 is a schematic representation demonstrating the relative height of the inclined section being 25% of the stack height.

Referring now to FIG. 17, a reduced radius hem tool 88 that includes a flat forming surface 90 and inclined forming surfaces 92 and 93 that are oriented to contact the bending flange 26. The arrows on the left side of FIG. 17 illustrate the reduced stack height of approximately 25% compared to the stack height illustrated by the arrows in the center of FIG. 17. This reduction in stack height should be compared with the stack height achieved by the compressed-radius hem tool 100 shown in FIG. 18.

Figure 18:
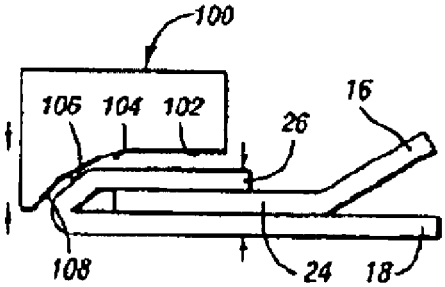
FIG. 18 is a schematic view showing the relative height of the inclined section being 100% of the stack height.

In FIG. 18, the arrows at the left side of the figure illustrate a stack height to the stack height corresponding to the arrows shown in the center of FIG. 18 wherein the stack height is equal to three thicknesses of the material forming the hem. The three inclined surfaces 104, 106, and 108, combine to define a concave portion and result in a greater degree of flexibility in the manufacturing process.

Figure 19:
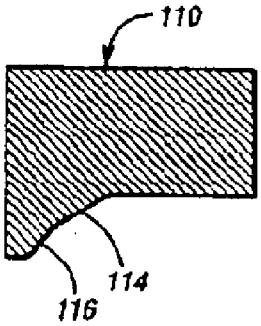
FIG. 19 is a schematic view showing a reciprocating ram press compressed-radius hem tool having a flat hemming surface and two obliquely angled straight sections.

Referring now to FIG. 19, another embodiment of the compressed-radius hem tool 110 for reciprocal presses is shown that includes a flat forming surface 112, a first inclined forming surface 114, and second inclined forming surface 116 that provide a concave portion relative to the chord C shown as a dashed line. For greater manufacturing tolerances, a compressed radius hem tool 100 or 100' as shown in FIGS. 20 and 21, respectively, may be provided.

Figure 20:
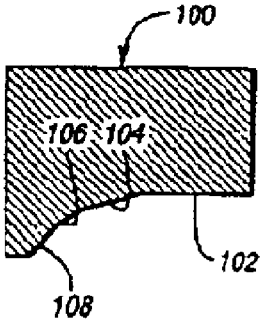
FIG. 20 is a schematic view showing a reciprocating ram press compressed-radius hem tool having a flat hemming surface and three obliquely angled sections.

In FIG. 20, the compressed-radius hem tool 100 includes a flat forming surface 102 and first, second, and third inclined forming surfaces 104, 106, and 108 that are each obliquely angled relative to the flat forming surface 102 but are of decreasing degrees of obliqueness relative thereto. Surfaces 104, 106, and 108 define a concave portion relative to the chord C.

Figure 21:
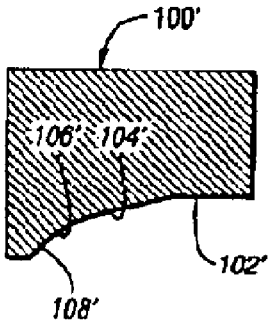
FIG. 21 is a schematic view showing a reciprocating ram press compressed-radius hem tool having a flat hemming surface and three obliquely angled sections.

In FIG. 21, a similar compressed-radius hem tool 100' is shown that has a flat forming surface 102 and the same number of inclined forming surfaces, but the first inclined forming surface 104 is substantially elongated in comparison to the other inclined forming surfaces 106 and 108 to provide an increased degree of manufacturing tolerance when compared to the embodiment shown in FIG. 20.

While the best mode for carrying out the invention has been described in detail, those familiar with the art to which this invention relates will recognize various alternative designs and embodiments for practicing the invention as defined by the following claims.

What is claimed is:

1. A tool for forming a hem on a sheet metal assembly comprising an inner panel having an outwardly extending flange and an outer panel having a bendable flange that is initially oriented generally perpendicular to an outer peripheral portion of the outer panel, the tool comprising:

a supporting surface on which the outer panel and inner panel are located;

a roller having a cylindrical surface and a shaped portion, the cylindrical surface being oriented to contact an inner portion of the bendable flange of the outer panel, the cylindrical surface pressing the bendable flange inwardly toward the outwardly extending flange of the inner panel in a first direction, the shaped portion extending from a first circumferential line at the intersection of the shaped portion and the cylindrical surface to a second circumferential line axially spaced from the first circumferential line and formed by at least two surfaces that together define a cavity relative to a chord extending between the first and second circumferential lines, and wherein the shaped portion engages an intermediate portion of the bendable flange between a bight portion and the inner portion of the flange and applies a force to the intermediate portion at an angle relative to the first direction to compress the hem radially as the cylindrical surface presses against the inner portion of the flange.

2. The tool of claim 1 wherein the surfaces defining the cavity include two conical surfaces that lie in two different coaxial conical sections that are coaxial with the cylindrical surface.

3. The tool of claim 2 wherein the surfaces defining the cavity further include a third conical surface that lies in a third coaxial conical section that is different than the two other conical sections and coaxial with the cylindrical surface.

4. The tool of claim 3 wherein the surfaces defining the cavity further include a fourth conical surface that lies in a fourth coaxial conical section that is different than the three other conical sections and coaxial with the cylindrical surface.

5. The tool of claim 1 wherein the surfaces defining the cavity further include a conical surface that is coaxial with the cylindrical surface and a curved surface that is contiguous with the conical surface.

6. The tool of claim 5 wherein the curved surface is between the conical surface and the cylindrical surface and is also contiguous with the cylindrical surface.

7. The tool of claim 1 wherein a bend in the bendable flange of the outer panel between the inner portion of the bendable flange and the intermediate portion of the bendable flange is engaged by the roller proximate the first circumferential line.

8. The tool of claim 1 wherein the shaped portion applies force in a direction normal to the intermediate portion of the flange.

9. The tool of claim 1 wherein the cylindrical surface is used in a pre-hemming step to initially bend the flange from its initial generally perpendicular orientation to extend at an angle of generally 45° and partially over the outwardly extending flange of the inner panel.

10. The tool of claim 1 wherein the shaped portion has an outer circumference that is greater than the circumference of the cylindrical surface.

11. The tool of claim 1 wherein the concave shaped portion has an outer circumference that is less than the circumference of the cylindrical surface.

12. A forming tool for forming a compressed radius hem for securing two panels together comprising:

a first forming surface that is parallel to a perimeter portion of an inner panel and oriented for pressing a distal portion of a hem flange of the outer panel toward a surface of the inner panel in a first direction, a second forming surface contiguous with the first forming surface that is oriented at a first oblique angle relative to the first forming surface; and a third forming surface contiguous with the second forming surface that is oriented at a second oblique angle relative to the first forming surface that is less oblique to the first forming surface than the first oblique angle, wherein at least one of the second or third forming surfaces engages an intermediate portion of the hem flange and applies a force to the intermediate portion in a second direction at an angle relative to the first direction to compress the hem radially as the first forming surface presses in the first direction against the distal portion of the hem flange.

13. The forming tool of claim 12 wherein the forming tool is a roller.

14. The forming tool of claim 12 wherein the forming tool is a press die.

15. A method of hemming an outer metal panel having a perimeter flange extending generally perpendicularly relative to the body of the outer panel and an inner metal panel together, the method comprising:

placing the inner panel and outer panel together;

forming the perimeter flange in a pre-hem pass with a roller to bend the perimeter flange to an acute angle relative to the body of the outer panel; and forming the perimeter flange of the outer panel in a final pass with the roller having a first forming surface continuous with a second forming surface wherein the first forming surface engages a distal edge portion of the perimeter flange and applying a force in a first direction, the second forming surface engages an intermediate portion of the perimeter flange between a bight portion and the distal edge portion of the perimeter flange and applying a force at a first angle relative to the first direction to compress the hem radially as the first forming surface presses against the distal edge portion of the flange.

16. The method of claim 15 wherein a third forming surface is provided that is spaced from the first forming surface and is contiguous with the second forming surface and is oriented at a second oblique angle relative to the first forming surface that is less oblique than the first oblique angle.

* * * * *